US006450730B1

(12) United States Patent
Matthias et al.

(10) Patent No.: US 6,450,730 B1
(45) Date of Patent: Sep. 17, 2002

(54) CURB FORMING MACHINE AND RELATED METHODS

(75) Inventors: Robert D. Matthias, Orlando; James E. Kirkland, Apopka, both of FL (US)

(73) Assignee: The Concrete Edge Company, Orlando, FL (US)

( * ) Notice: Subject to any disclaimer, the term of this patent is extended or adjusted under 35 U.S.C. 154(b) by 0 days.

(21) Appl. No.: 09/850,306

(22) Filed: May 7, 2001

Related U.S. Application Data

(60) Provisional application No. 60/226,109, filed on Aug. 17, 2000.

(51) Int. Cl.[7] ..... E01C 11/22

(52) U.S. Cl. ..... 404/98; 404/75; 404/101; 404/96

(58) Field of Search ..... 404/98, 96, 75, 404/101, 105, 7; 425/62, 64

(56) References Cited

U.S. PATENT DOCUMENTS

| | | | | | |
|---|---|---|---|---|---|
| 2,932,875 | A | * | 4/1960 | Butcher | 404/98 |
| 3,583,911 | A | * | 6/1971 | Vlasic | 404/98 |
| 3,733,140 | A | * | 5/1973 | James, III | 404/98 |
| 3,733,141 | A | * | 5/1973 | James, III | 404/98 |
| 4,310,293 | A | * | 1/1982 | Eggleton | 404/98 |
| 4,384,806 | A | * | 5/1983 | Taylor, Jr. | 404/98 |
| 4,566,823 | A | * | 1/1986 | May | 404/98 |
| 4,936,763 | A | * | 6/1990 | Thomas | 404/98 |
| 5,527,129 | A | * | 6/1996 | McKinnon | 404/98 |
| 6,171,019 | B1 | * | 1/2001 | Casimaty et al. | 404/98 |

* cited by examiner

*Primary Examiner*—Thomas B. Will
*Assistant Examiner*—Alexandra K. Pechhold
(74) *Attorney, Agent, or Firm*—Allen, Dyer, Doppelt, Milbrath & Gilchrist, P.A.

(57) ABSTRACT

The curb forming and extruding machine forms continuous concrete edging while reducing and/or substantially eliminating voids, flat spots or weak areas caused by smoothed sections in the packed concrete. Also, concrete bridging in the hopper, and the associated problems, are reduced and/or eliminated. The curb forming machine includes a plunger which is driven along a path of travel including a forward position to force the curb forming material from the lower hopper section into and through the curb extrusion mold, an upward position so that the plunger extends into the upper hopper section, and a rearward position away from the curb mold and in the lower hopper section. The plunger extending into the upper section of the hopper eliminates concrete bridging and also scores the concrete as it packs it into the mold.

18 Claims, 5 Drawing Sheets

CURB FORMING MACHINE AND RELATED METHODS

RELATED APPLICATION

This application is based upon prior filed copending provisional application Serial No. 60/226,109 filed Aug. 17, 2000.

FIELD OF THE INVENTION

The present invention relates to the field of curb forming, and more particularly, to machines and methods for extruding and forming continuous curbs or borders.

BACKGROUND OF THE INVENTION

Many commercial and residential property owners use some type of border or edging to enhance the appearance of their landscaping. For example, edging is used to separate or provide a transition from a flowerbed to a grass area. The edging also typically provides a root barrier. Conventional edging may include the use of wood, plastic, brick, pre-cast cement sections, chemicals or shoveling and trimming, for example.

Another type of edging is continuous custom concrete edging. The continuous concrete edging is formed using a portable curb forming and extruding machine such as those manufactured by The Concrete Edge of Orlando, Fla. Such machines typically include a reciprocating ram or an auger to force concrete or other building materials through a mold. The machine may also include a hopper for receiving the concrete material, and a motor and gear box for driving the ram or auger.

The continuous concrete edging may be about six inches high by about six inches wide, for example, and may be applied on parking lots, driveways, walkways, paths and around flowerbeds and other planting areas. Furthermore, the continuous concrete edging provides a permanent and durable root barrier that will not rot, separate or lose its luster even when run over by mowers and trimmers. Of course, the continuous concrete edging saves time on weeding and trimming and adds value to the property.

An example of an auger type machine is disclosed in U.S. Pat. No. 5,354,189 to McKinnon entitled "Curb Forming and Extruding Apparatus." This curb extrusion device has a segmented vibrating hopper into which building materials are placed to fall onto two tapered counter rotating vibrating augers.

An example of a reciprocating ram type machine is disclosed in U.S. Pat. No. 5,527,129 to McKinnon entitled "Elliptical orbit compaction curb forming and extruding apparatus." This extruder has a reciprocating compacting member which on the compaction stroke simultaneously moves forward to compact the concrete and lifts upward slightly, between ½ and ⅝ of an inch, just before the return stroke to force the compressed concrete against the upper surface of the slip form.

One problem with these machines is referred to as concrete bridging. The concrete material being shoveled into the hopper is usually relatively dry so that it holds the form of the curb after being extruded from the machine. Unfortunately, this sometimes causes it to bridge from side to side in the hopper and not fall through into the chamber where the ram or auger is located to force the material through the mold. Because these machines are self-propelled via the curb being extruded through the mold, when bridging occurs, the machine stops and the operator has to manually break the concrete bridge with a shovel, for example. This results in wasted time and less efficient installation of the curb.

Another problem with a typical linear reciprocating ram type machine is the creation of voids, flat spots or weak areas in the extruded curb. The reciprocating ram moves in a linear motion from the back of the lower part of the hopper towards the mold or slip form. When the ram pulls back from the mold, the end of the exposed packed concrete is smoothed from the face of the ram. During the next cycle, more concrete is packed against the smoothed end of the concrete in the mold. As those skilled in the art are aware, such smoothed sections result in voids, flat spots or weak areas in the extruded curb.

SUMMARY OF THE INVENTION

In view of the foregoing background, it is therefore an object of the invention to provide a curb forming and extruding machine which forms continuous concrete edging while reducing voids, flat spots or weak areas in the extruded curb, and the problems caused by concrete bridging in the hopper.

This and other objects, features and advantages in accordance with the present invention are provided by a curb forming machine including a hopper carried by a frame and including an upper hopper section, for receiving curb forming material, and a lower hopper section. A curb extrusion mold is adjacent the lower hopper section for receiving the curb forming material therefrom to extrude a curb. Furthermore, a plunger and associated drive move the plunger along a path of travel including a forward position to force the curb forming material from the lower hopper section into and through the curb extrusion mold, an upward position so that the plunger extends into the upper hopper section, and a rearward position away from the curb mold and in the lower hopper section.

The path of travel of the plunger to the upward position is preferably greater than the path of travel between the rearward and forward positions. Moreover, the path of travel of the plunger to the upward position is about seven inches, and the path of travel between the rearward and forward positions is about four inches. The drive may include a motor and a gear box having an output shaft connecting the motor to the plunger. The drive may further include an eccentric arm rotatably connecting the plunger to the output shaft, a first shaft mounted to the frame, a second shaft connected to a medial portion of the plunger, and a plurality of rocker arms pivotally connecting the second shaft to the first shaft. A plurality of wheels may be connected to the frame with an associated steering mechanism for steering the curb forming machine.

Objects, features and advantages in accordance with the present invention are provided by a method of forming a curb including providing curb forming material into a hopper having an upper hopper section for receiving the curb forming material, and a lower hopper section, and providing a curb extrusion mold adjacent the lower hopper section for receiving the curb forming material from the lower hopper section and extruding a curb. The method also includes moving a plunger along a path of travel including a forward position to force the curb forming material from the lower hopper section into and through the curb extrusion mold, an upward position so that the plunger extends into the upper hopper section, and a rearward position away from the curb mold and in the lower hopper section.

A curb forming and extruding machine and method are provided to form continuous concrete edging while reducing and/or substantially eliminating voids, flat spots or weak areas in the extruded curb. The machine and method also reduce the problems caused by concrete bridging in the hopper. The motion of the plunger to extend into the upper section of the hopper eliminates concrete bridging and also scores the concrete as it packs it into the mold.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
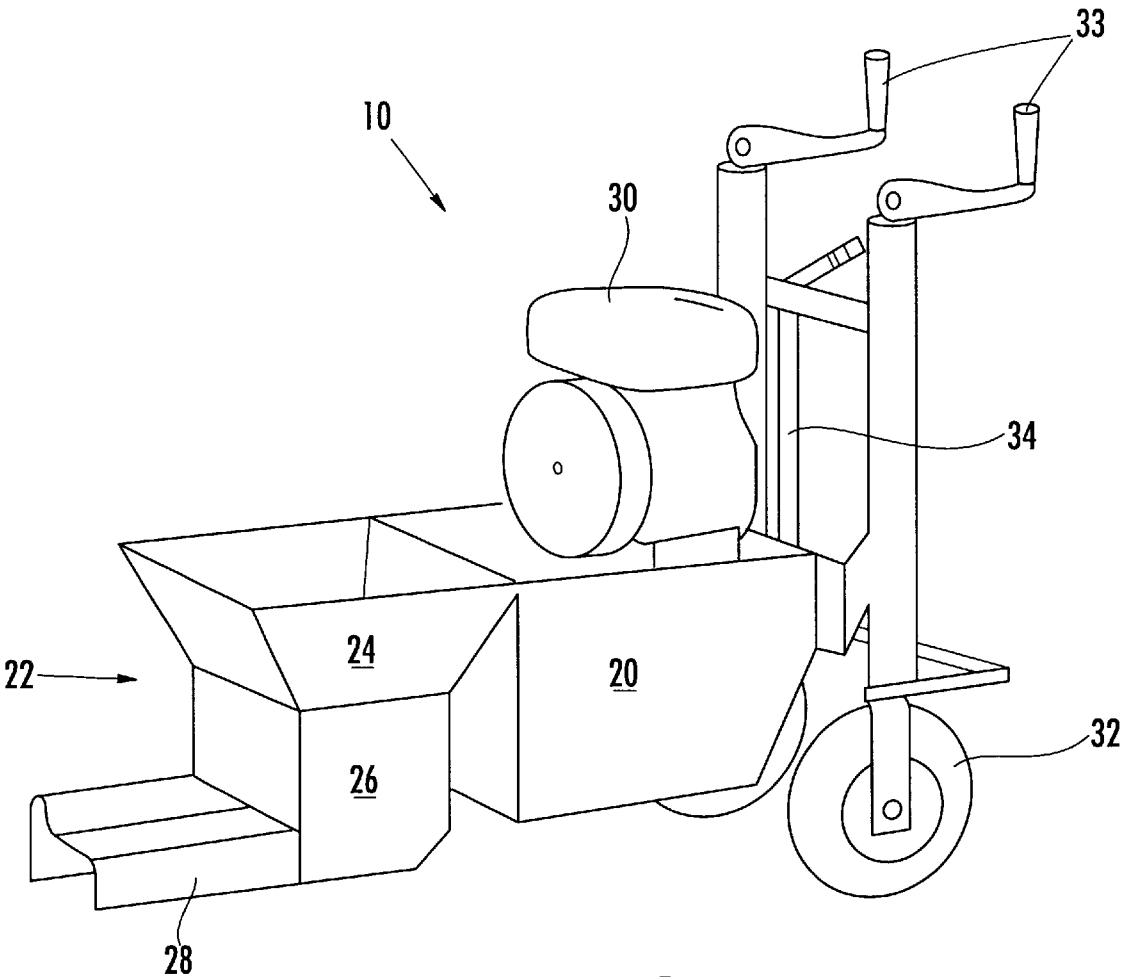
FIG. 1 is a plan view of a curb forming and extruding machine in accordance with the present invention.
Figure 2:
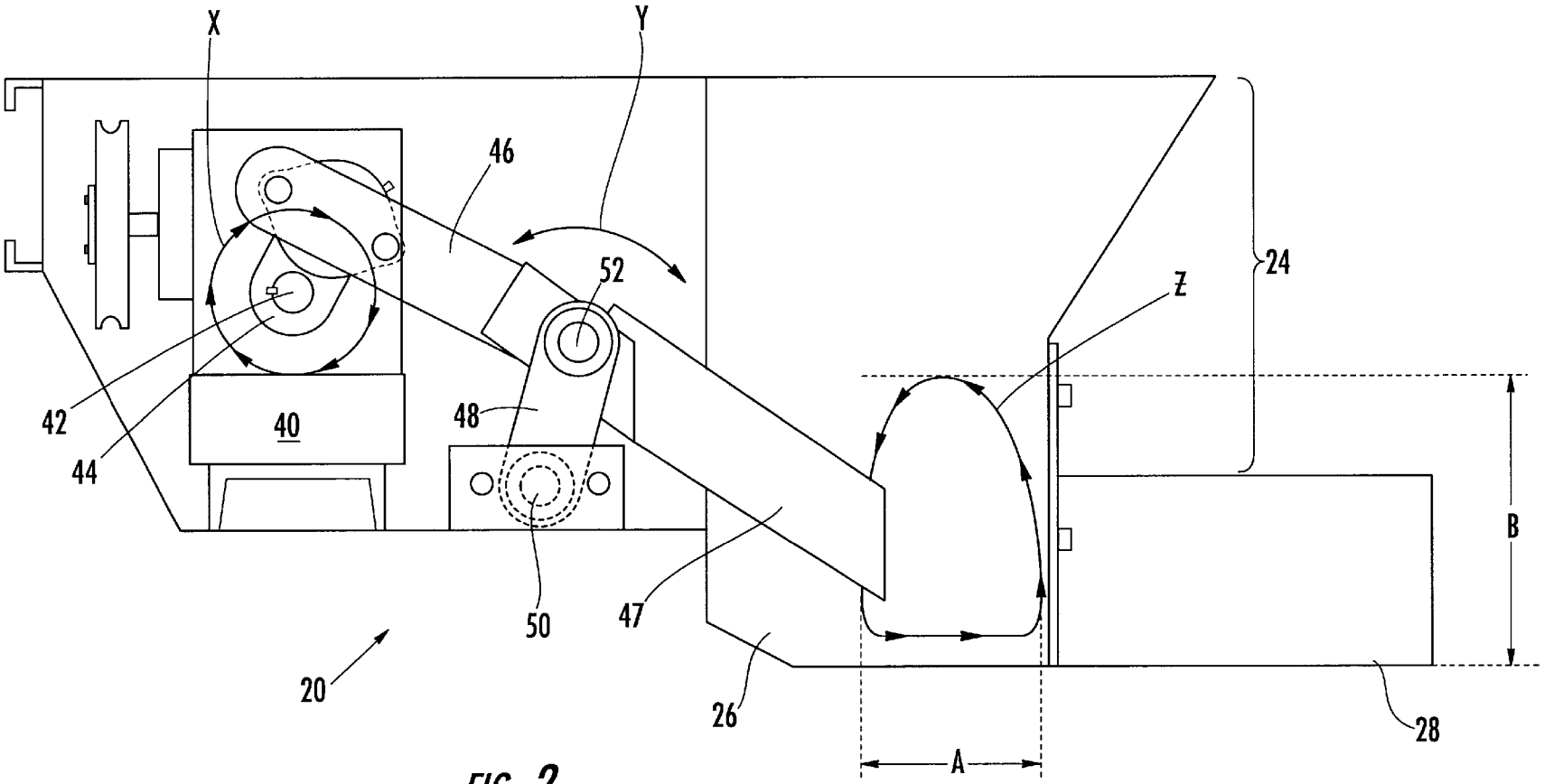
FIG. 2 is a side view of the interior of the chassis schematically illustrating the motion of the plunger of the machine of FIG. 1.
Figure 3:
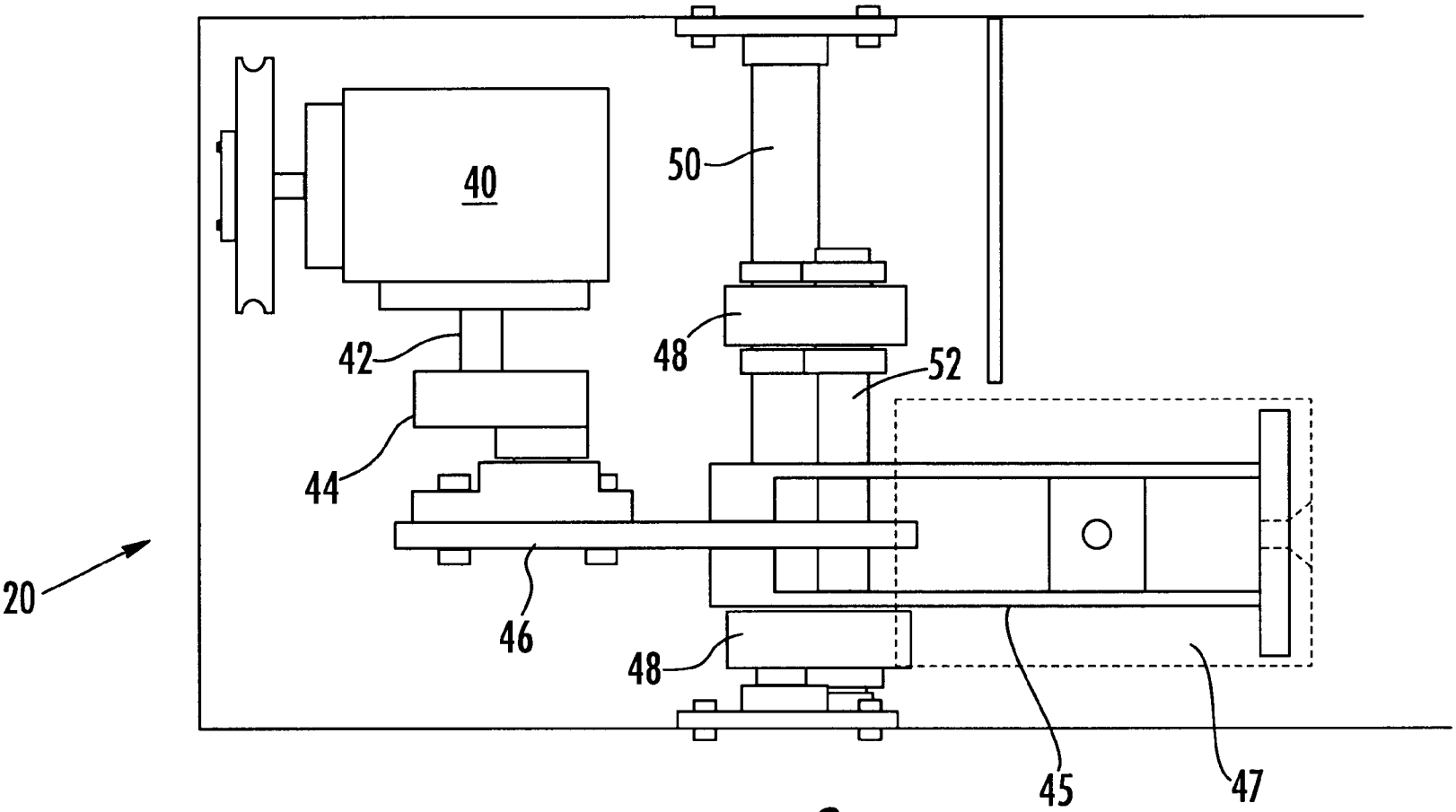
FIG. 3 is a top view of the interior of the chassis schematically illustrating the plunger and relative connections in the machine of FIG. 1.

Referring to FIGS. 1–3, a curb forming and extruding machine 10 in accordance with the present invention will now be described. The curb forming machine 10 includes a frame or chassis 20 having a hopper 22 with an upper hopper section 24 for receiving curb forming material from an external source, and a lower hopper section 26 for receiving the curb forming material from the upper hopper section. As is known to those skilled in the art, an operator typically shovels small amounts of curb forming material, such as concrete, into the upper hopper section 24. Then, the concrete is gravity fed to the lower hopper section 26.

The machine further includes a curb extrusion mold 28 adjacent the lower hopper section 26 for receiving the curb forming material from the lower hopper section and extruding a curb in a desired shape defined by the mold. As is also know to those skilled in the art, the mold 28 is removably mounted to the frame 20 and may be formed in a variety of shapes to create corresponding cross-sections of extruded curb. Also, a plurality of wheels 32 may be connected to the frame 20, and a steering mechanism 34 connected to the wheels for steering the curb forming machine 10. Handles 33 and an associated mechanism for adjusting the height of the front of the machine 10 may also be provided.

A motor 30 is mounted on the frame 20 with a gear box 40 connected thereto. The motor 30 drives the gear box 40 which transfers power via an output shaft 42 and eccentric arm 44 to a plunger 46. The plunger 46 includes an extended plunger portion 45 and a plunger head 47 for forcing the curb forming material from the lower hopper section 26 into and through the curb mold 28. A first shaft 50 is fixedly mounted to the frame 20, a second shaft 52 is connected to a medial portion of the plunger 46, and a plurality of rocker arms 48 pivotally connect the second shaft to the first shaft.

Figure 4:
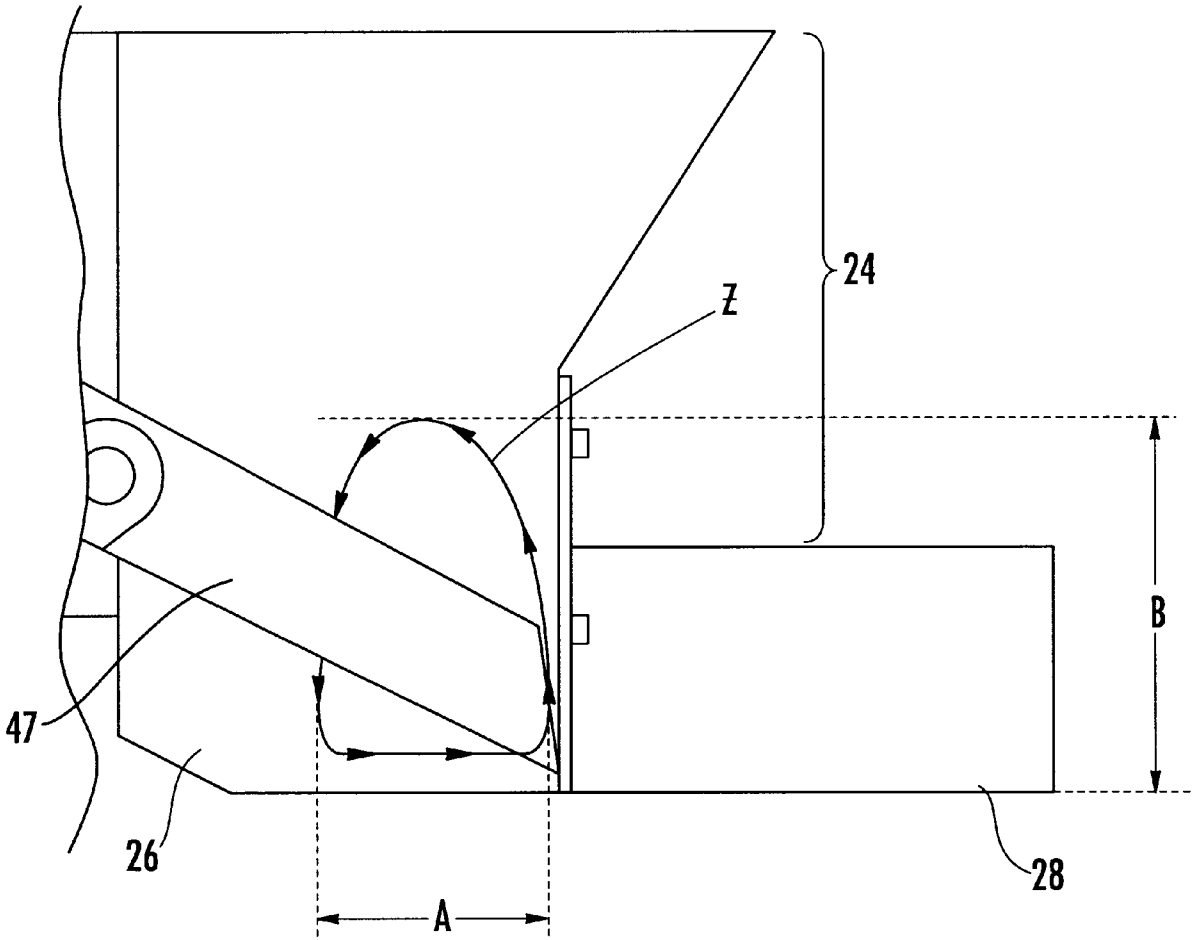
FIGS. 4 and 5 are side views schematically illustrating the plunger in different positions along the path of travel.
Figure 5:
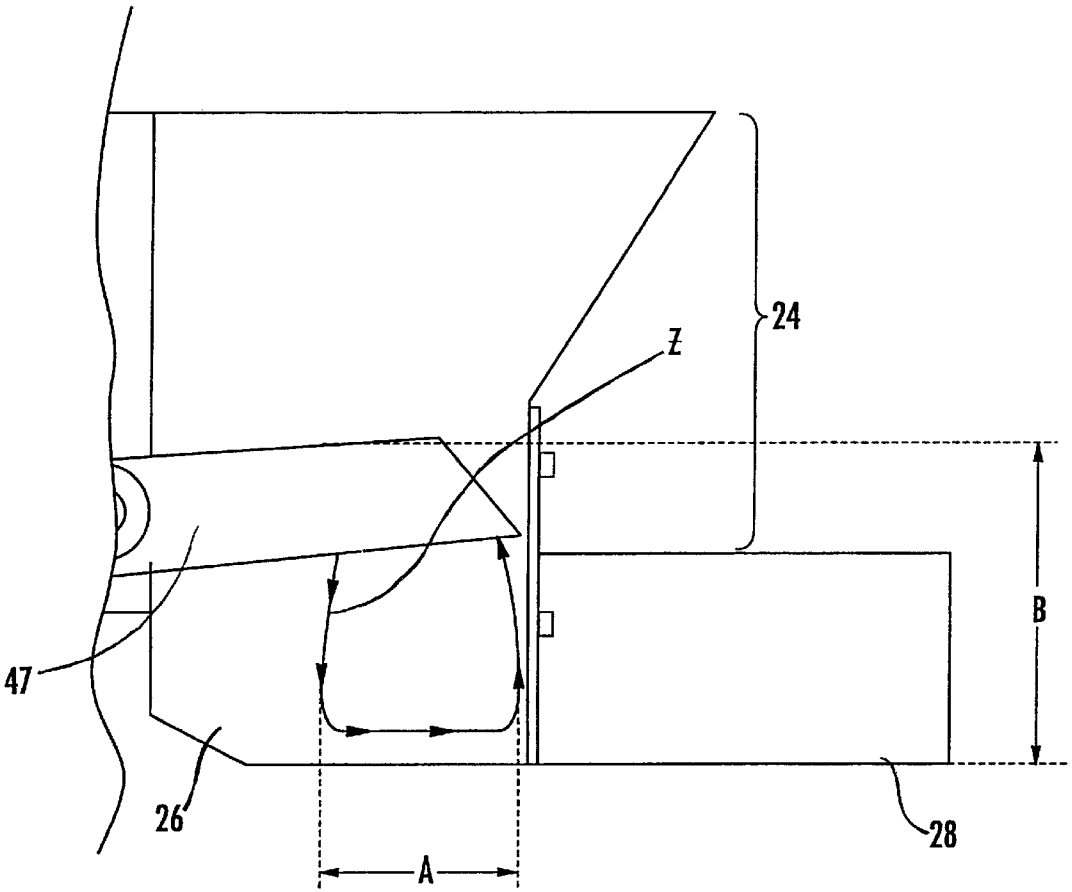

While specifically referring to FIGS. 2, 4 and 5, the path of travel of the plunger 46 will now be described in detail. As the gear box 40 rotates output shaft 42, the eccentric arm 44 is rotated therearound in a motion indicated by the arrowed-line X. While the end of the plunger 46 rotatably connected to the eccentric arm 44 is also rotated around the output shaft 42, the rocker arms 48, connected to the plunger 46 via second shaft 52, pivot in a motion indicated by the arrowed-line Y on the axis defined by first shaft 50. The resulting path of travel of the plunger head 45 is indicated by the arrowed-line Z including a forward position (FIG. 4) to force the curb forming material from the lower hopper section 26 into and through the curb extrusion mold 28, an upward position (FIG. 5) so that the plunger 46 extends into the upper hopper section 24, and a rearward position away from the curb mold 28 and in the lower hopper section 26 (FIG. 2).

The path of travel of the plunger head 45 to extend into the upper section 24 of the hopper 22 eliminates concrete bridging and also scores the concrete as it packs it into the mold 28. By scoring the concrete as it is packed into the mold 28, smoothed sections are eliminated and the continuous concrete edging is formed without voids, flat spots or weak areas. Also, only one machine operator is necessary to install the curb due to the reduction and/or elimination of undesired concrete bridging in the hopper 22.

The path of travel of the plunger 46 from the forward position (FIG. 4) to the upward position (FIG. 5) to extend into the upper hopper section 24 is preferably greater than the path of travel from the rearward position (FIG. 2) to the forward position (FIG. 4) toward the curb mold in the lower hopper section. For example, movement B of the plunger 46 upward to extend into the upper hopper section 24 is preferably about seven inches, and the movement A toward the curb mold 28 in the lower hopper section 26 is about four inches.

A method of forming a curb in accordance with the present invention includes forcing the curb forming material from the lower hopper section 26 into and through the curb mold 28 by moving the plunger 46 in a predetermined path of travel. Again, the path Z preferably includes movement from a rearward position (FIG. 2) in the lower hopper section 26 toward the curb mold 28 to a forward position (FIG. 4), movement from the forward position to an upward position (FIG. 5) to extend into the upper hopper section 24, and movement from the upward position away from the curb mold 28 and downward into the lower hopper section 26 back to the rearward position.

An improved curb forming and extruding machine 10 and method are provided for forming continuous concrete edging without voids, flat spots or weak areas. Again, the machine 10 and method also eliminate the problems caused by concrete bridging in the hopper 22. As discussed above, the path of travel Z of the plunger 46 including extending into the upper section of the hopper 22 eliminates concrete bridging and also scores the concrete as it packs it into the mold 28. The curb forming and extruding machine 10 and method of the present invention can create a consistent flow of concrete with each revolution of the plunger 46. For example, 2.25 inches of concrete curb can be extruded every 1.2 seconds. Thus, continuous concrete borders can be produced and allow the user to follow any existing landscape bed design.

Many modifications and other embodiments of the invention will come to the mind of one skilled in the art having the benefit of the teachings presented in the foregoing descriptions and the associated drawings. For example, the path of travel Z of the plunger 46 to extend into the upper hopper section 24 may be produced by other mechanisms such as a guide wheel and corresponding track. Therefore, it is understood that the invention is not to be limited to the specific embodiments disclosed, and that modifications and embodiments are intended to be included within the scope of the appended claims.

That which is claimed is:

1. A curb forming machine comprising:

a frame;

a hopper carried by the frame and including an upper hopper section, for receiving curb forming material, and a lower hopper section;

a curb extrusion mold adjacent the lower hopper section for receiving the curb forming material therefrom to extrude a curb; and a plunger and associated drive for moving the plunger along a path of travel including a forward position to force the curb forming material from the lower hopper section into and through the curb extrusion mold, an upward position so that the plunger extends into the upper hopper section, and a rearward position away from the curb mold and in the lower hopper section.

2. A curb forming machine according to claim 1 wherein the path of travel of the plunger to the upward position is greater than the path of travel between the rearward and forward positions.

3. A curb forming machine according to claim 2 wherein the path of travel of the plunger to the upward position is about seven inches, and the path of travel between the rearward and forward positions is about four inches.

4. A curb forming machine according to claim 1 wherein the drive comprises:

a motor; and a gear box connecting the motor to the plunger.

5. A curb forming machine according to claim 4 wherein the gear box comprises an output shaft; and wherein the drive further comprises an eccentric arm rotatably connecting the plunger to the output shaft.

6. A curb forming machine according to claim 5 wherein the drive further comprises:

a first shaft mounted to the frame;

a second shaft connected to a medial portion of the plunger; and a plurality of rocker arms pivotally connecting the second shaft to the first shaft.

7. A curb forming machine according to claim 1 further comprising:

a plurality of wheels connected to the frame; and a steering mechanism connected to the wheels for steering the curb forming machine.

8. A curb forming machine comprising:

a frame;

a hopper carried by the frame and including an upper hopper section, for receiving curb forming material, and a lower hopper section;

a curb extrusion mold adjacent the lower hopper section for receiving the curb forming material therefrom to extrude a curb; and a plunger and associated drive for moving the plunger along a path of travel to force the curb forming material from the lower hopper section into and through the curb extrusion mold;

the drive comprising a motor;

a gear box connected to the motor;

a first shaft mounted to the frame;

a second shaft connected to a medial portion of the plunger; and a plurality of rocker arms pivotally connecting the second shaft to the first shaft.

9. A curb forming machine according to claim 8 wherein the drive moves the plunger along a path of travel including a forward position to force the curb forming material from the lower hopper section into and through the curb extrusion mold, an upward position so that the plunger extends into the upper hopper section, and a rearward position away from the curb mold and in the lower hopper section.

10. A curb forming machine according to claim 9 wherein the path of travel of the plunger to the upward position is greater than the path of travel between the rearward and forward positions.

11. A curb forming machine according to claim 10 wherein the path of travel of the plunger to the upward position is about seven inches, and the path of travel between the rearward and forward positions is about four inches.

12. A curb forming machine according to claim 8 wherein the gear box comprises an output shaft; and the drive further comprises an eccentric arm rotatably connecting the plunger to the output shaft.

13. A curb forming machine according to claim 8 further comprising:

a plurality of wheels connected to the frame; and a steering mechanism connected to the wheels for steering the curb forming machine.

14. A method of forming a curb comprising:

providing curb forming material into a hopper including an upper hopper section for receiving the curb forming material, and a lower hopper section;

providing a curb extrusion mold adjacent the lower hopper section for receiving the curb forming material from the lower hopper section and extruding a curb; and moving a plunger along a path of travel including a forward position to force the curb forming material from the lower hopper section into and through the curb extrusion mold, an upward position so that the plunger extends into the upper hopper section, and a rearward position away from the curb mold and in the lower hopper section.

15. A method according to claim 14 wherein the path of travel of the plunger to the upward position is greater than the path of travel between the rearward and forward positions.

16. A method according to claim 15 wherein the path of travel of the plunger to the upward position is about seven inches, and the path of travel between the rearward and forward positions is about four inches.

17. A method according to claim 14 wherein moving the plunger comprises:

rotatably connecting a first end of the plunger to an eccentric arm; and rotatably connecting the eccentric arm to an output shaft of a gear box.

18. A method according to claim 17 wherein moving the plunger further comprises:

providing a first shaft which is fixed in relation to the plunger;

providing a second shaft connected to a medial portion of the plunger; and pivotally connecting the second shaft to the first shaft with a plurality of rocker arms.

* * * * *